US005702108A

United States Patent [19]

Todokoro

[11] Patent Number: 5,702,108

[45] Date of Patent: Dec. 30, 1997

[54] GAME BOARD

[75] Inventor: Masatoshi Todokoro, Tokyo-To, Japan

[73] Assignee: Agatsuma Co., Ltd., Tokyo-to, Japan

[21] Appl. No.: 753,337

[22] Filed: Nov. 22, 1996

[51] Int. Cl.[6] ..... A63F 9/00

[52] U.S. Cl. ..... 273/447; 273/120 R

[58] Field of Search ..... 273/445, 447, 273/120 R

[56] References Cited

U.S. PATENT DOCUMENTS 4,119,312 10/1978 Todokoro ..... 273/447

*Primary Examiner*—William H. Grieb

*Attorney, Agent, or Firm*—Longacre & White

[57] ABSTRACT

A game board comprises; a table board; body parts; extrusive bodies; hollow catching bodies each of which is made in the shape of an animal's head or the like pivotally mounted to the front end of each of the extrusive bodies and has an open bottom part contacting a wall surface of the table board; driving plates each of which is put in a loose-fit so as to be reciprocatingly shiftable between the front endside and the rear end side of each of the extrusive bodies; projections each of which works so as to push up each of the catching bodies from the table board; levers each of which works so that an end thereof engaging with each of the driving plates may push, via each of the driving plates, each of the extrusive bodies out of each of the body parts when a projecting end of each of the levers is pulled; and springs each of which energises each of the levers so that the lever's end engaging with each of the driving plates may draw, via each of the driving plates, each of the extrusive bodies up to its original position when the projecting end of each of the levers is released, characterised in that the game board is equipped with booty forwarding levers which forward booties to be caught by catching bodies into a table board when levers are operated and interlocking mechanisms each of which causes each of the booty forwarding levers to be driven once every time each of the levers is operated a plurality of times.

8 Claims, 6 Drawing Sheets

GAME BOARD

BACKGROUND OF THE INVENTION (1) Field of the Invention

This invention relates to a game board with which a game can be played in which a suitable number of catching bodies made in the shape of an animal's head or the like are caused to rush from peripheral parts of a table board toward the central part of the table board in order to scramble for booties such as balls forwarded to the central part of the table board, and in particular relates to an improvement of a "game board", JP. Utility Model Application No. 6-9616 on which the applicant of the present invention previously applied for Utility Model in Japan.

(2) Description of the Prior Art

Up to now, a variety of electronics-used game boards or such game boards as baseball boards and soccer boards have been developed and provided to the market, but these all are complicated in structure and operation.

Aforementioned game boards, in particular, game boards complicated in structure and operation, however, are hard for infants to handle and difficult for infants to take an interest in. Accordingly it has been requested to provide such a game board that, especially, operation is made simpler and at the same time an interest is taken by infants, and therefore the applicant of the present invention previously applied for a utility model on a "game board" registered as JP. Utility Model Application No. 6-9616 and further has created an for g the "game board", JP. Utility Model Application No. 6-9616, so that each of games can be played for a longer time.

SUMMARY OF THE INVENTION

For achieving the aforementioned object, a game board according to the present invention comprises; a table board; body parts made in the shape of an animal's body or the like and fixedly arranged along the peripheral part of the table board; extrusive bodies each of which is arranged so that it may be extruded from inside of each of the body parts to the central part of the table board and formed in such a manner that its wall surface near its rear end may be continuous with its inclined surface inclining from its front end side toward its rear end side; pressing springs projectingly arranged so that each thereof may come into pressing contact with a part of the wall surface of each of the extrusive bodies within a range from a position near its front end side to a position abutting on the aforesaid inclined surface during a process of each of the extrusive bodies being extruded; hollow catching bodies each of which is made in the shape of an animal's head or the like pivotally mounted on the front end of each of the extrusive bodies and has an open bottom part contacting a wall surface of the table board; driving plates each of which is put in a loose-fit so as to be reciprocatingly shiftable between the front end side and the rear end side of each of the extrusive bodies; projections each of which works so as to push up each of the catching bodies from the table board when each of the driving plates is shifted from the rear end side to the front end side of each of the extrusive bodies; levers each of which, one end thereof engaging with each of the aforesaid driving plates and the other end thereof projecting outside of each of the body parts, works so that the end engaging with each of the driving plates may push, via each of the driving plates, each of the extrusive bodies out of each of the body parts when the projecting end is pulled; and springs each of which energises each of the levers so that the lever's end engaging with each of the driving plates may draw, via each of the driving plates, each of the extrusive bodies up to its original position when the aforesaid projecting end of each of the levers is released; characterised in that the game board is provided with booty forwarding levers which forward booties to be caught by the aforesaid catching bodies into the aforesaid table board when the aforesaid levers are operated, and is provided with interlocking mechanisms each of which causes each of the aforesaid booty forwarding levers to be driven once every time each of the aforesaid levers is operated a plurality of times, characterised in that each of the aforesaid interlocking mechanisms is provided with a base plate which makes rocking motion interlocking with the lever tip end part of each of the aforesaid levers, slide members each of which is slidably mounted on the aforesaid base plate and shifts on the aforesaid base plate interlocking with the movement of the aforesaid lever tip end part, rotary plates each of which is supported on the aforesaid base plate so as to be able to rotate according to the movement of the aforesaid slide member, and engagement projections which are installed plurally in number in a radial manner on the back surface of each of the aforesaid rotary plates along the circumference thereof and the outer end parts of which protrude from the circumference of the rotary plate to such positions as makes it possible to make sliding contact with each of the aforesaid booty forwarding lever, characterised in that the aforesaid engagement projections move toward the tip end part of the aforesaid booty forwarding lever according to the rotation of the aforesaid rotary plate and the aforesaid engagement projections make sliding contact with the aforesaid booty forwarding lever at the rate of once to a plurality of times of operations of the aforesaid levers, and characterised also in that the aforesaid booty forwarding lever is pivotally mounted on a bearing fixed to the back surface of the aforesaid table board and discharges the aforesaid booties onto the aforesaid table board when the tip end of the aforesaid booty forwarding lever is lifted toward the aforesaid table board by the aforesaid engagement projections making sliding contact with the tip end part of the aforesaid booty forwarding lever.

DETAILED DESCRIPTION OF THE PREFERRED EMBODIMENTS

Figure 1:
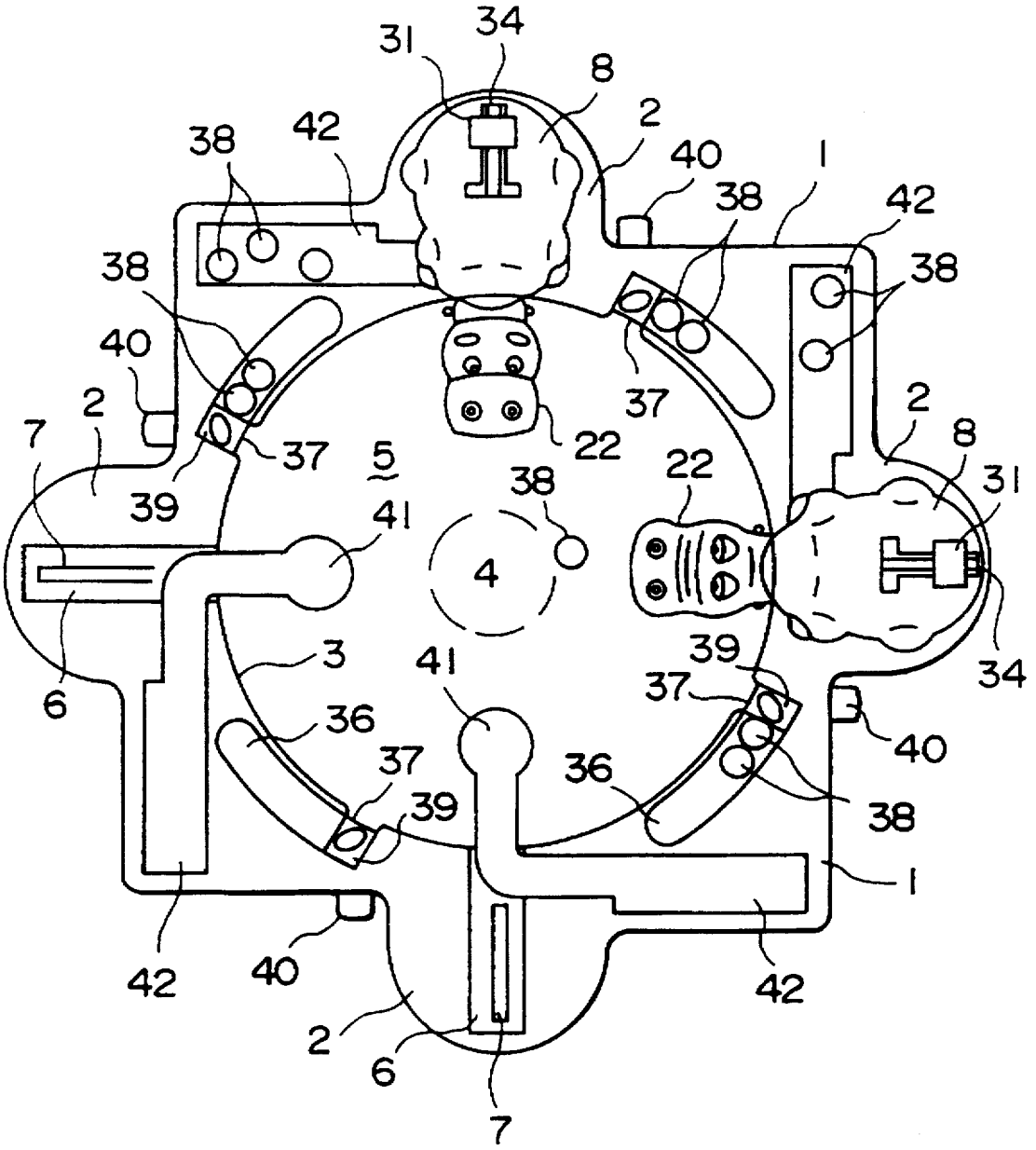
FIG. 1 is a partly omitted top plan view of a game board according to the present invention.

A preferred embodiment of the present invention is now described referring to the drawings.

Figure 2:
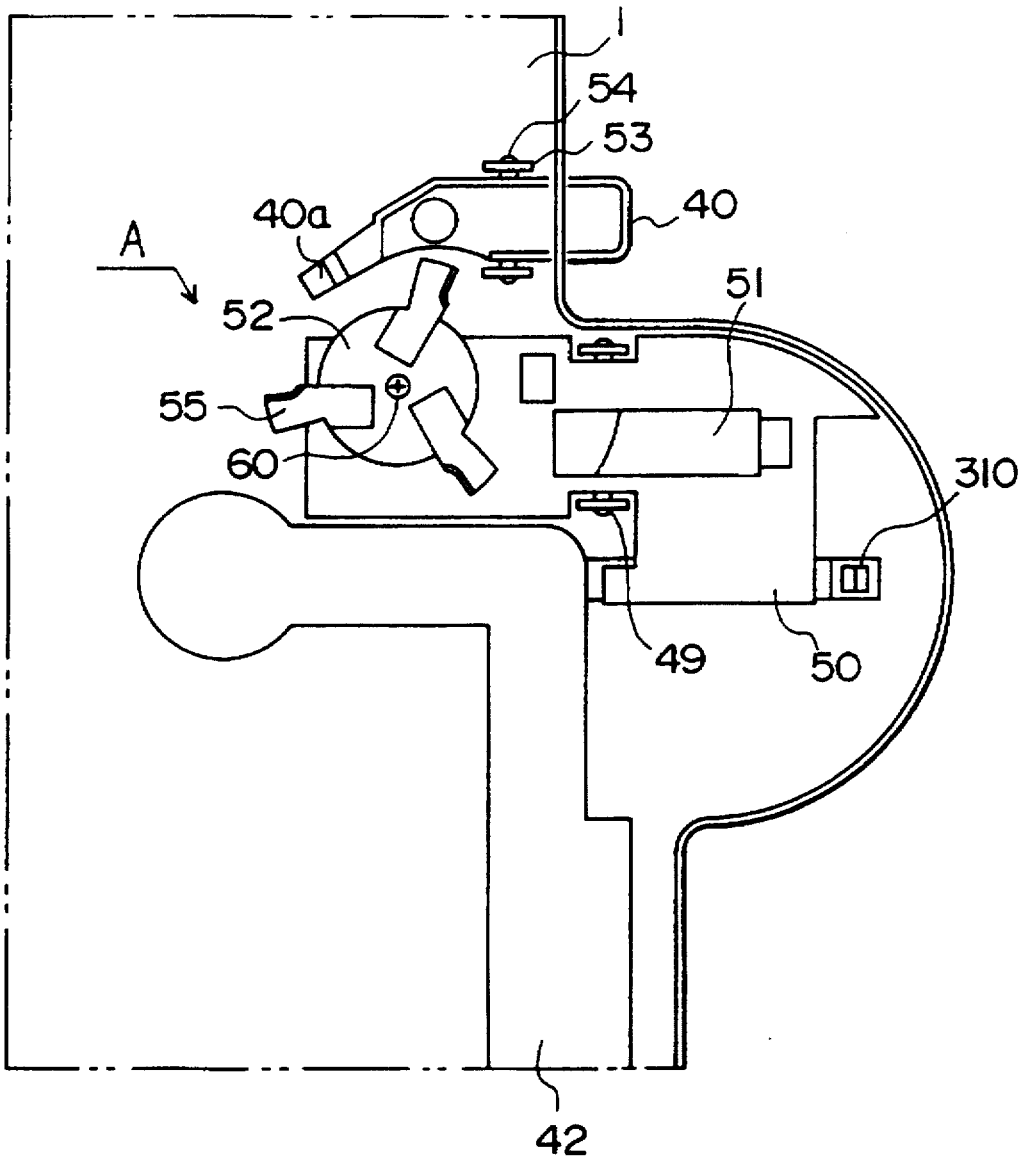
FIG. 2 is a partial bottom view of an interlocking mechanism.
Figure 8:
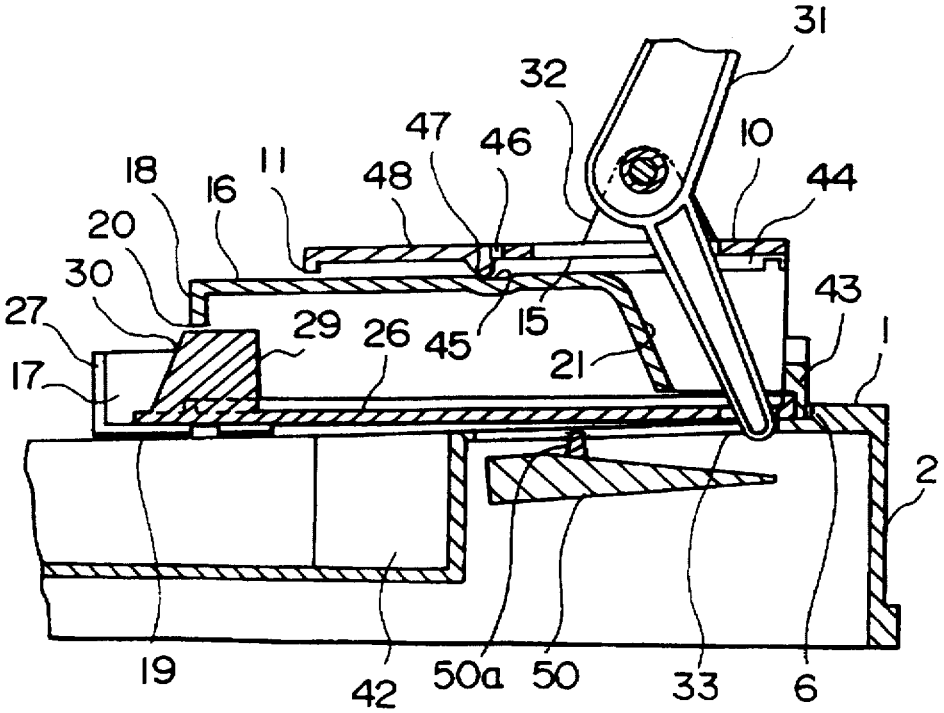
FIG. 8 is an enlarged sectional view illustrating a state of the extrusive body pressed by the pressing spring.

When a lever 31 is pushed, a ball forwarding lever (a booty forwarding lever) 40 is driven via an interlocking mechanism "A" and a ball 38 is discharged onto a planar part 4 of a table board 1 by an action of the said ball forwarding lever 40. In the interlocking mechanism "A", as shown in FIG. 2 and FIG. 8, a base plate 50 is pivotally attached to a bearing 49 fixed to the back surface of the table board 1 while a projection 50*a* is formed on the top surface of the base plate 50 and, when the lever 31 is pushed, the lever tip end part 310 engages with the projection 50*a*, causing the base plate 50 to make rocking motion, with the bearing 49 used as a fulcrum, in the direction shown by the arrow "a".

Figure 3:
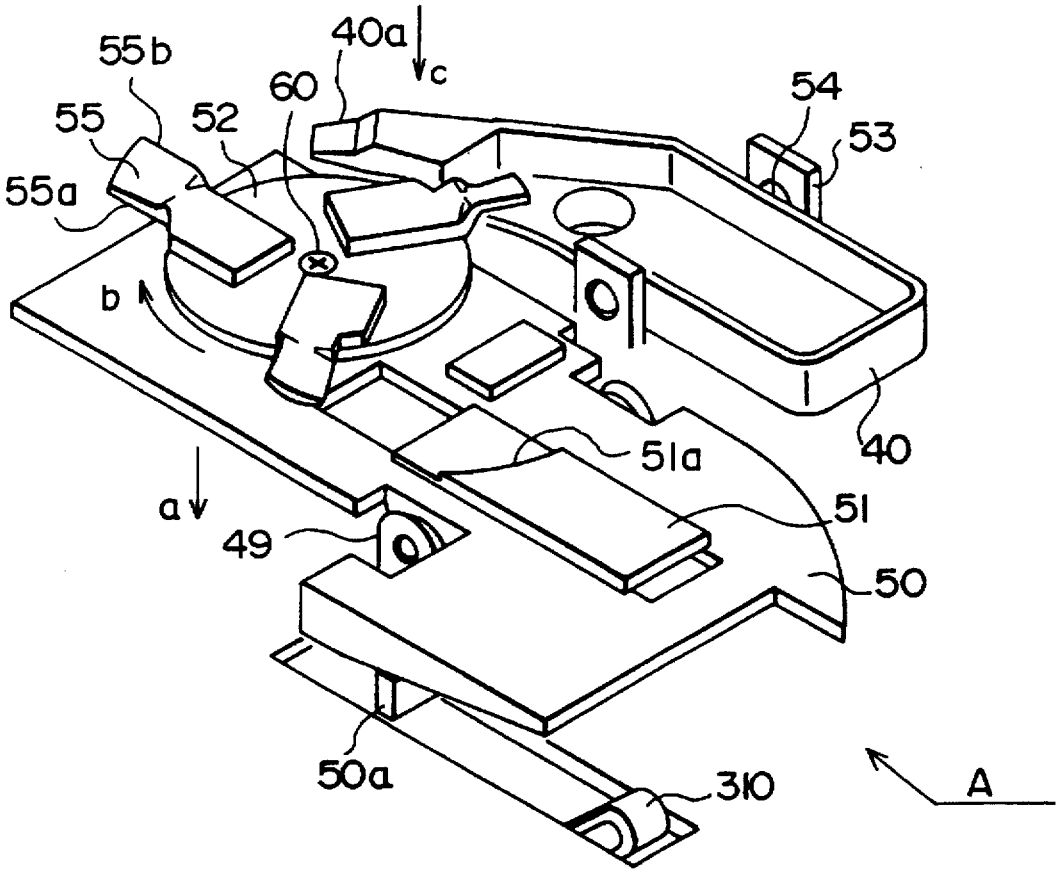
FIG. 3 is a perspective view from bottom side of the interlocking mechanism.
Figure 4:
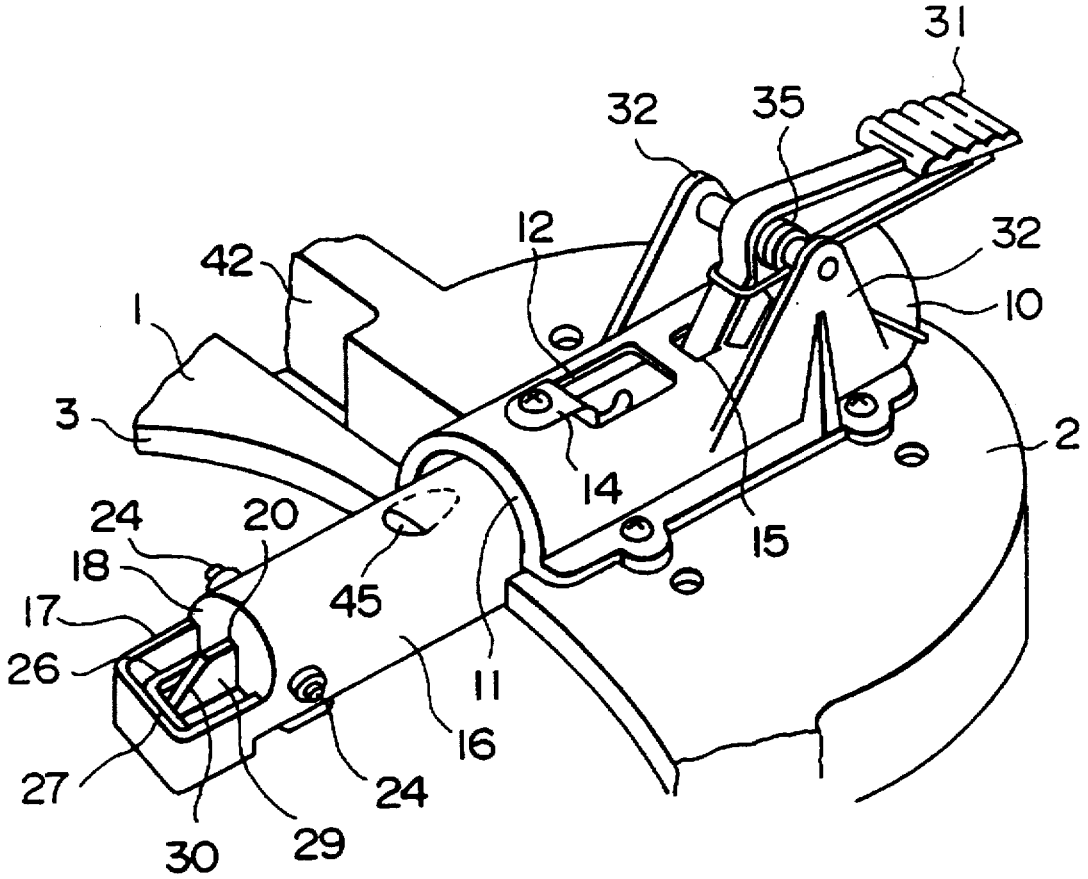
FIG. 4 is a perspective view illustrating an embodiment of the extruding mechanism of an extrusive body.

A slide member 51, which slidingly moves on the base plate 50 by the engagement with the lever tip end part 310, is provided in the center of the base plate 50 and a rotary plate 52, which is freely-rotatably supported by a pivot 60 and rotated by the slide member 51 in the direction shown by the arrow "b", is provided, in front of the slide member 51, on the back surface (top surface according to FIG. 3) of the base plate 50.

Engagement projections 55 are provided on a surface of the rotary plate 52, arranged in a radial manner at positions dividing into three equal parts the circumference thereof, and engage with the ball forwarding lever 40 (where, the number of the engagement projections can be a plural number other than three). Each of these three engagement projections 55 is equipped with an engagement side 55*a* formed on the back side thereof which engages with a curved engagement part 51*a* formed on the front end of the slide member 51 while equipped with a slide side 55*b* formed on the front end side thereof which inclines so as to become higher toward the rotational direction thereof (the direction shown by the arrow "b"), and this engagement side 55*b* pushes up in the direction shown by the arrow "c" an inclined part of the tip end of the ball forwarding lever 40 while engaging therewith. The ball forwarding lever 40 is freely-rotatably supported on a bearing 53 fixed to the table board 1 via a protruding pin 54.

In this way, when the lever 31 is pushed, the base plate 50 rocks in the direction shown by the arrow "a" and, at the same time, rotates the engagement projections 55 of the rotary plate 52 in the direction shown by the arrow "b". When one of the engagement projections 55 makes sliding contact with the tip end part 40*a* of the ball forwarding lever 40, this tip end part 40*a* is shifted instantaneously in the direction shown by the arrow "c" and a ball 38 is discharged onto the planar part 4 of the table board 1 by an action of the ball forwarding lever 40.

In this embodiment, action timing of the rotary plate 52 related to the lever 31 is established so that each of the engagement projections 55 may push down the ball forwarding lever 40 once every time the lever 31 is pushed down three times. Accordingly balls 38 are caused to jump out onto the planar part 4 of the table board 1 at the rate of one ball to three times of pushing-down of the lever 31 and, as a result, one game can be played for a long time. In addition, the rate of the number of ball-jump-out times to the number of pushing times of the lever 31 may be established as one thinks fit.

Nextly, when the lever 31 is returned to its original position, the catching body 22 selectively catches one of balls 38. Costitution therefor is now described in greater detail. In the FIGS. 1 to 8, the reference numeral 1 denotes the table board which has four sides of the same length and an appropriate height, 2 denotes projecting parts projecting in a semicircle from the central part of each of the sides of the table board 1, 3 denotes a stepped part which sinks making a circle near the board face peripheral part of the table board 1, and a ring-shaped board face 5, which extends from the circular stepped part 3 to the circular planar part 4 arranged on the board face central part, is inclined so as to become higher toward the side of the stepped part 3 and to become lower toward the planar part 4. The numeral 6 denotes inclined grooves which are formed so as to pass the top surface central part of each of the aforesaid projecting parts 2 and to be continuous with the aforesaid ring-shaped board face part 5, with the bottom surface of which joined to the board face part 5 on a level therewith.

The numeral 7 denotes an oblong hole bored along the center line of the bottom part of each of the aforesaid inclined grooves 6, and 8 denotes a hollow body part which is fixed on the top surface of the aforesaid projecting part 2, has an outside shape made in the shape of an animal's body or the like, and is equipped with an opening part 9 on an end part thereof located close to the circular stepped part 3. The numeral 10 denotes a semicircular cross section frame, located inside of each of the aforesaid body part 8, fixed to each of the projecting parts 2 so as to straddle each of the inclined grooves 6, and equipped with; openings on its front end close to the front side of the body part 8 and on its rear end close to the rear end side thereof respectively; a projecting rim 11 projectingly installed inside of its front end; an open hole 12 on its top surface in a part lying somewhat toward its front end from its middle; and an oblong hole 15 in a part ranging from a position close to its rear end to its middle position.

The numeral 13 denotes a spring fixing seat formed in a position close to the hole 12 of the frame 10, and 16 denotes an extrusive body of semicircular arc-shaped cross section having a certain wall thickness, the rear end side of which is fitted into inside of the aforesaid frame 10 through the opening 9 of each of the aforesaid body parts 8, the front end side of which is protruded from each of the body parts 8, and the bottom part of which is fitted in the inclined groove 6 freely-slidably therealong.

The numeral 17 denotes a cell formed protrudingly outside of a front end plate 18 of each of the aforesaid extrusive bodies 16, the top of which is opened, to the bottom of which a bottom plate 19 is applied, and the front end plate 18 of the extrusive body 16 is equipped with a cutout part 20 by cutting the front end plate 18 from the center part of its lower side upward for causing the inside of the extrusive body 16 to communicate with the inside of the cell 17.

The numeral 21 denotes an inclined surface which, inclined from the front end side toward the rear end side, is formed so as to be continuous with an end of a cutout made by cutting out the top wall near the rear end of each of the aforesaid extrusive bodies 16. The numeral 14 denotes a pressing spring comprising a plate spring, one end of which is fixed to the spring fixing seat 13 and the other end of which is brought into pressing contact with the top wall surface each of the extrusive bodies 16 through the open hole 12, and 45 denotes a recess part provided for releasing the pressing contact made by the pressing spring 14 in a position where the pressing spring 14 makes pressing contact with the top wall surface of each the extrusive bodies 16 in a state before each of the extrusive bodies 16 is extruded from each of the body parts 8.

The numeral 22 denotes a hollow catching body which is made in shape of an animal's head, the bottom part of which is opened (opening denoted by a numeral 23), and the rear end side of which is pivotally attached to a pivot 24 projectingly installed on the both sides of the front end of each of the aforesaid extrusive bodies 16, while the cell 17 is inserted inside of each of the catching bodies 22. The numeral 25 denotes a projection projectingly installed, in each of the catching bodies 22, close to the top surface of the cell 17, and 26 denotes a driving plate which, being loose-fitted in the bottom part of each of the extrusive bodies 16 so as to be reciprocatingly movable between the front end side and the rear end side thereof, moves reciprocatingly within a range of a play space 28 produced between the front end part of the driving plate 26, which is put on the bottom plate 19 of the cell 17 freely-slidably, and the front end plate 27 of the cell 17.

The numeral 29 denotes a projection projectingly installed on the front end top part of each of the aforesaid driving plates 26 having an inclined end face 30 formed by cutting off obliquely the front end side of the projection 29, and when the driving plate 26 is shifted to the front end of the extrusive body 16, the projection 29 invades inside of the cell 17 through the cutout part 20 provided in the front end plate 18 of the extrusive body 16, and the inclined and face 30 hits against the front end of the projection 25 of each the catching bodies 22, causing each of the catching bodies 22 to be raised from the board face of the table board 1 using the pivotally-attaching part 24 as a fulcrum, and as a result the opening part 23 of the bottom part becomes open.

The numeral 31 denotes a lever for extruding/pulling back each of the extrusive bodies 16 from/to each of the body parts 8, the middle part of which is pivotally hung on a bearing 32 equipped on the frame 10, the front end side of which being inserted successively into the oblong hole 15 of the frame 10, the rear end cutout 44 of the extrusive body 16, an open hole 33 bored in the rear end side of the driving plate 26, and the oblong hole 7 bored in the projecting part 2 of the table board 1, and the rear end side of which is projected outside of the body part 8 through an oblong hole 34 bored in the top surface of the body part 8.

The numeral 35 denotes a spring arranged on each of the aforesaid levers 31 for energizing each of the lever 31 so as always to draw each of the extrusive bodies 16 toward the body part 8. The numeral 36 denotes a ball storing groove provided on the board face close to the circular stepped part 3 between body parts 8 neighboring to each other, which has a communicating mouth 37 communicating with the ring-shaped board face part 5 inclined inwardly inside of the circular stepped part 3, the bottom part of which is inclined so as to become lower toward the communicating mouth 37.

The numeral 38 denotes balls stored in each of the ball storing grooves 36, 39 denotes a cutout hole formed by cutting out the bottom part, which is continuous with the communicating mouth 37, of each of the ball storing grooves 36, and 40 denotes a ball forwarding lever the front end part of which is attached on the lower surface of the aforesaid cutout hole 39 so as to be capable of rising/falling interlocking with pushing the lever 31, and in operation, the lever 40 catches a ball 38 rollingly coming along the inclined bottom part of the ball storing groove 36 with the front end part of the lever 40 lowered, and thereafter, the front end part of the lever 40 instantaneously rises interlocking with pushing the lever 31 at the rate of once to three times, causing the ball 38 to be forwarded to the board face center part of the table board 1.

The numeral 41 denotes a ball take-in mouth which opens in the ring-shaped board face part 5 at a position to which each of the catching bodies 22 returns after being extruded by the extrusive body 16, and 42 denotes a ball receiving groove formed so as to communicate with the aforesaid ball take-in mouth 41, starting from each of the corners in the board face of the table board 1.

Operation of the game board thus constituted is now described. The lever 31 projecting outside of each of the body parts 8 is pulled all together against the spring 35 and, at the same time, the ball forwarding lever 40, via the interlocking mechanism "A", sends out one ball 38 each from the ball storing groove 36 to the center of the table board 1.

Figure 5:
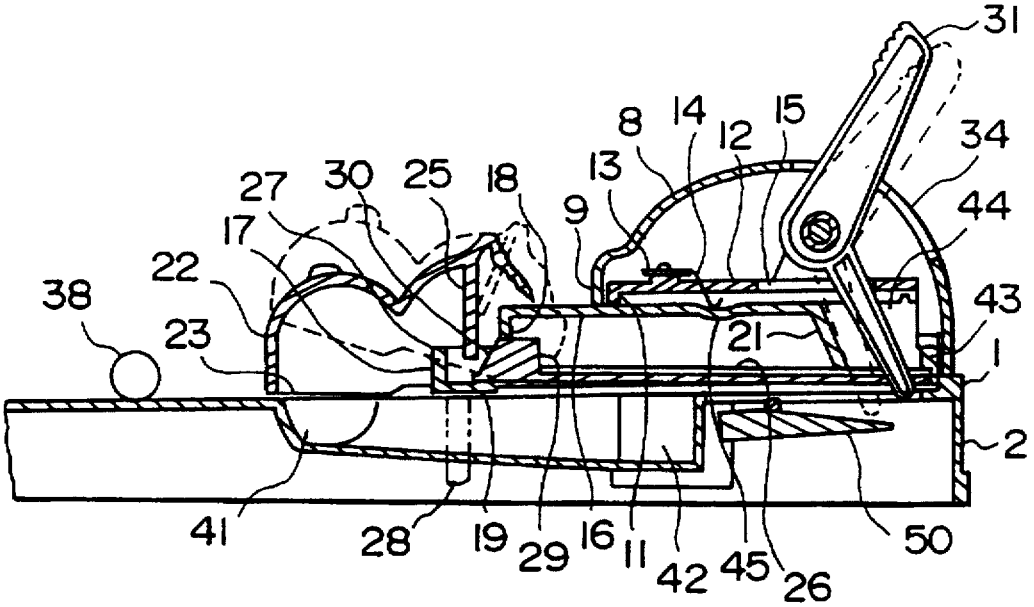
FIG. 5 is a sectional view illustrating a state of the extrusive body yet to be extruded out of a body part.
Figure 6:
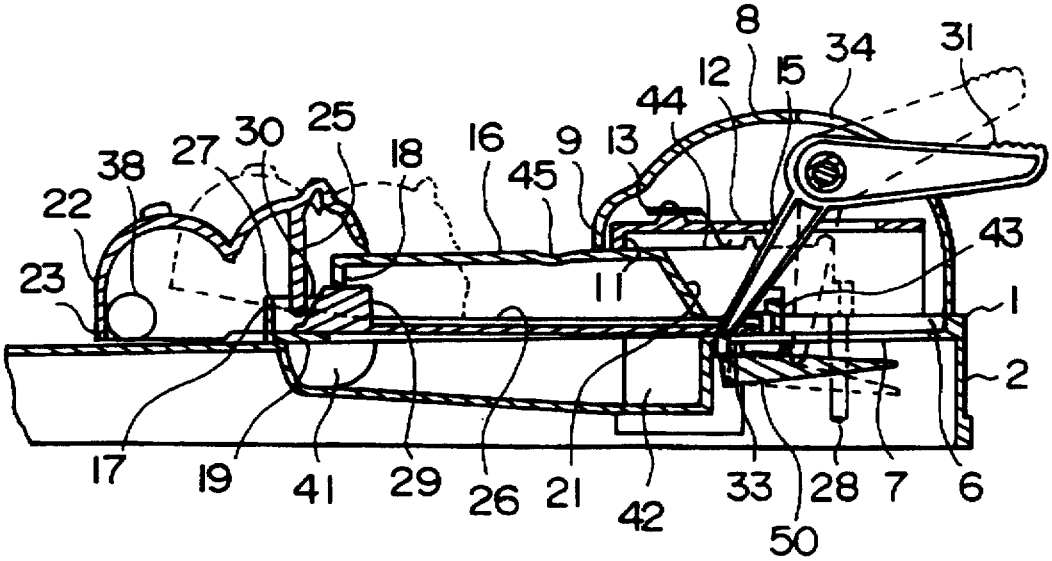
FIG. 6 is a sectional view illustrating a state of the extrusive body having been extruded out of the body part.

Then, as shown in dotted lines in FIG. 5, each of the driving plates 26 is first shifted from the rear end side toward the front end side of each of the extrusive bodies 16 and, at the same time, the projection 29 of the front end part of each of the driving plates 26 invades into the cell 17 through the cutout part 20 and the inclined end part 30 thereof hits against the projection 25 in each of the catching bodies 22, causing each of the catching bodies to be raised from the board face of the table board 1, and as a result the opening part 23 of the bottom part thereof becomes open.

Successively, the front end of each of the driving plates 26 pushes the front end plate 27, causing each of the extrusive bodies 16 to be extruded from inside of each of the body part 8 toward the center of the table board 1. In the process of each of these extrusive bodies being extruded, immediately after each of the extrusive bodies 16 is extruded, the pressing spring 14 which has been idle until then comes into pressing contact with the top wall surface of each of the extrusive bodies 16, the pressing spring 14 continues to press each of the extrusive bodies 16 against the wall surface of the table board 1 until the inclined surface 21 reaches the pressing spring 14, each of the catching bodies 22 advances with its bottom opening part 23 opened, and when the inclined part 21 reaches the pressing spring 14 as shown in dotted lines in the FIG. 6, the pressing spring 14 makes pressing contact with the inclined surface 21, and therefore each of the extrusive bodies 16 is acted on by force to extrude it toward the central part of the table board 1, causing each of the extrusive bodies 16 to advance farther by the play space 28 produced between the rear end plate 43 thereof and the rear end of each of the driving plates 26, whereby the projection 25 in each of the catching bodies 22 parts from the inclined end face 30 of the projection 29 and each of the catching bodies 22 is released from its raised state and each of the catching bodies 22 falls onto the central part of the table board 1 as shown in full lines in FIG. 6.

Among the catching bodies 22, only a catching body 22 which has arrived just above one of balls 38 takes the ball in the inside space part thereof.

By releasing each of the levers 31 when each of the catching bodies 22 has fallen in the central part of the board face, each of the lever 31 returns to its original position due to the elasticity of the spring 35, causing the rear end of each of the driving plates 26 to push the rear end plate of each of the extrusive bodies 16, thereby each of the extrusive bodies 16 being pulled back into each of the body parts 8, and each of the catching bodies 22 is returned, with its posture fallen on the board face of the table board 1, to its original position as shown in full lines in the FIG. 5. The ball 38 drops from the catching body 22, which has caught the ball 38, into the ball take-in mouth 41 and then rolls into the ball receiving groove 42, and a scramble for balls 38 is thus winned.

In a process of each of the catching bodies 22 returning to its original position, the pressing spring 14 slides on the inclined surface 21 on the rear end side of each of the catching bodies 22 and then makes pressing contact with the top wall surface thereof, and when each of the catching bodies 22 has returned to its original position, the spring 14 faces the recess 45, resulting in that pressing is released.

A game of scrambling for balls 38 can be continued by repeating the above-described actions.

Figure 7:
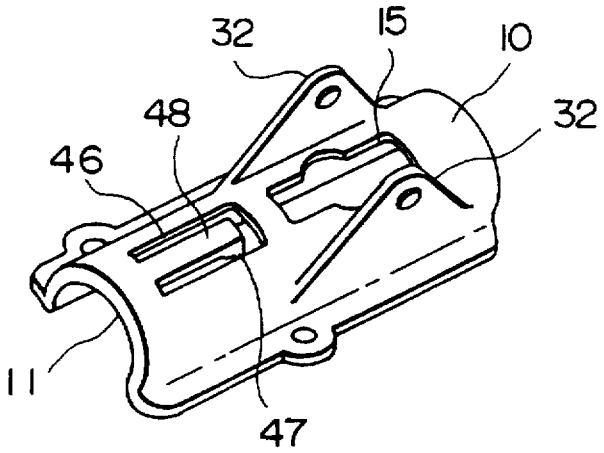
FIG. 7 is a perspective view for illustrating a changed embodiment of a pressing spring.

In addition, concerning the pressing spring for pressing each of the extrusive bodies 16, alternative constitution is possible where, instead of the pressing spring 14 comprising a plate spring as described in the above embodiment, a pressing spring 48 can be provided, the tip end of which has a spring effect and the tip end bottom surface of which has a projection 47, by cutting out (cutout denoted by a numeral 46) the frame 10 as shown in FIG. 7 in U-shape in its top part near its front end, and this pressing spring 48 presses the top surface of the extrusive body 16 fitted in the frame 10 as shown in FIG. 8, but the pressing spring 14 comprising a plate spring has an advantage that motions of the catching bodies 22 can be made more certain because the pressing spring 14 allows a greater range of pressing contact with the inclined surface 21.

Furthermore, the respective shapes and numbers of the table board 1, the body parts 8, the extrusive bodies 16, and the catching bodies 22 may be changed as one thinks fit.

As described above, the present invention provides the game board, with which several infants, seated around the table board, decide upon their quotas of the booties, forward the booties such as balls to the central part of the table board by operating the lever each, and then scramble for the balls, and furthermore this game board is full of amusing action that catching bodies made in the shape of an animal's body or the like are pushed up from the board face of the table board, that they rush with their mouths open, and that, just before they arrive in the central part, they fall onto the board face to take in the booties such as balls, and at the same time, one time of this game can be enjoyably played for a longer time than existing games because the booties such as balls are forwarded at a rate of one piece to a plurality of times of operations of the levers.

What is claimed is:

1. A game board comprising:

a table board;

a plurality of body parts made a shape of an animal's body or the like and fixedly arranged along a peripheral part of said table board;

a plurality of extrusive bodies each of which is arranged so that it may be extruded from inside a corresponding one of said body parts to a central part of said table board and formed in such a manner that a wall surface near a rear end may be continuous with an inclined surface inclining from a front end side toward a rear end side;

a plurality of pressing springs projectingly arranged so that each thereof may come into pressing contact with a part of the wall surface of a corresponding one of said extrusive bodies within a range from a position near the front end side to a position abutting on said inclined surface during a process of each of said extrusive bodies being extruded;

a plurality of hollow catching bodies each of which is made in a shape of an animal's head pivotally mounted on the front end of a corresponding one of said extrusive bodies and has an open bottom part contacting a wall surface of said table board;

a plurality of driving plates each of which is put in a loose-fit so as to be reciprocatingly shiftable between the front end side and the rear end side of a corresponding one of said extrusive bodies;

a plurality of projections each of which works so as to push up a corresponding one of said catching bodies from said table board when a corresponding one of said driving plates is shifted from the rear end side to the front end side of said corresponding one of said extrusive bodies;

a plurality of levers each of which, one end thereof engaging with a corresponding one of said driving plates and the other end thereof projecting outside of a corresponding one of said body parts, works so that an end engaging with said corresponding one of said driving plates may push, via each of said driving plates, each of said extrusive bodies out of each of said body parts when said projecting end is pulled;

a plurality of springs each of which energizes a corresponding one of said levers so that an end of said corresponding lever engaging with a corresponding one of said driving plates may draw, via each of said driving plates, a corresponding one of said extrusive bodies up to an original position when said projecting end of each of said levers is released;

booty forwarding levers which forward booties to be caught by said catching bodies into said table board when said levers are operated; and interlocking means disposed between each of said levers and said booty forwarding levers, each interlocking means causes a corresponding one of said booty forwarding levers to be driven once every time a corresponding one of said levers is operated a plurality of times.

2. The game board according to claim 1 wherein a lever tip end part of each of said levers is pivotally mounted to a bearing each fixed to a back surface of said table board; and each of said interlocking means comprising:

a base plate which makes rocking motion interlockingly with said lever tip end part;

slide members each of which is slidably mounted on said base plate and shifts on said base plate interlocking with a movement of said lever tip end part;

rotary plates each of which is supported on said base plate so as to be able to rotate according to a movement of said slide member; and engagement projections which are installed plurally in number in a radial manner on a back surface of each of said rotary plates along a circumference thereof and an outer end part of which protrude from the circumference of said rotary plate to such positions as makes it possible to make sliding contact with each of said booty forwarding lever.

3. The game board according to claim 1, wherein said engagement projections move toward a tip end part of said booty forwarding lever according to a rotation of said rotary plate and said engagement projections make sliding contact with said booty forwarding lever at a rate of once to a plurality of times of operations of said levers.

4. The game board according to claim 2, wherein said engagement projections move toward a tip end part of said booty forwarding lever according to a rotation of said rotary plate and said engagement projections make sliding contact with said booty forwarding lever at a rate of once to a plurality of times of operations of said levers.

5. The game board according to claim 3, wherein said booty forwarding lever is pivotally mounted on a bearing fixed to a back surface of said table board and discharges said booties onto said table board when the tip end of said booty forwarding lever is lifted toward said table board by said engagement projections making sliding contact with the tip end part of said booty forwarding lever.

6. The game board according to claim 4, wherein said booty forwarding lever is pivotally mounted on a bearing fixed to a back surface of said table board and discharges said booties onto said table board when the tip end of said booty forwarding lever is lifted toward said table board by said engagement projections making sliding contact with the tip end part of said booty forwarding lever.

7. A game board comprising:

a table board having a playing surface and a peripheral edge;

a ball delivery mechanism for delivering a ball to said playing surface, said ball delivery mechanism capable of successively delivering a plurality of balls to said playing surface;

at least one hollow catching body disposed atop said playing surface, said catching body being movably mounted to said table board adapted to capture at least one of said balls appearing on said playing surface and thereafter delivering said ball to said ball delivery mechanism;

an actuation means to actuate said hollow catching body to enable said body to capture at least one of said balls;

an interlocking mechanism connecting said ball delivery mechanism and said actuation means such that said ball delivery mechanism automatically delivers a ball to said playing surface once for every time said actuation means is actuated a plurality of times.

8. A game board comprising:

an extended base board with a surface, a defined periphery, a defined board center, and a ball delivery means to deliver a ball towards said board center;

a plurality of hollow structures modeled after a body portion of an animal and disposed at the base board an extrusive body for each hollow structure, each extrusive body having fore and rear ends, an upper frame, a bottom in each of said hollow structures, said bottom being slidable mounted with respect to said surface so that said extrusive body may be pushed out of said hollow structure towards said board center, a capturing structure shaped like the head of an animal pivotally joined to said fore end of said extrusive body, said capturing structure having a bottom opening which normally engages the board surface, a driving plate fitted in each of said extrusive bodies so that said driving plate is reciprocally moveable between said fore and rear ends of said extrusive body, said driving plate adapted to raise said capturing structure from the board surface when said driving plate is moved from said rear end to said fore end of said extrusive body;

a lever for each extrusive body, each having one end engaged with an associated driving plate and another end projecting out from the associated animal body shaped hollow structure with a center portion pivotally mounted to said upper frame at said rear end of said extrusive body so that when said end of said lever projecting out from said associated animal body part is moved back and forth, said driving plate operates to force out the corresponding extrusive body from said associated hollow structure and raise said capturing structure from said board surface;

a spring means coupled to said lever to bias said extrusive member to an original position; and an interlocking means for automatically operating said ball delivery means once for each time said lever is operated a plurality of times.

* * * * *